US005467075A

United States Patent [19]

Rand

[11] Patent Number: 5,467,075

[45] Date of Patent: Nov. 14, 1995

[54] ANTI-THEFT ALARM FOR AIR POWERED HAND TOOLS

[75] Inventor: Richard H. Rand, East Northport, N.Y.

[73] Assignee: Protex International Corporation, Bohemia, N.Y.

[21] Appl. No.: 398,361

[22] Filed: Mar. 3, 1995

[51] Int. Cl.[6] ..... G08B 13/14

[52] U.S. Cl. ..... 340/568; 200/51.16; 200/51.1; 340/571

[58] Field of Search ..... 340/568, 571; 200/51.16, 51.1, 51.09

[56] References Cited

U.S. PATENT DOCUMENTS

| | | | |
|---|---|---|---|
| 4,047,167 | 9/1977 | Helena | 340/568 |
| 4,837,555 | 6/1989 | Millar | 340/568 |
| 5,172,098 | 12/1992 | Leyden et al. | 340/568 |
| 5,241,297 | 8/1993 | Goodman | 340/568 |
| 5,258,744 | 11/1993 | Zeder | 340/568 |
| 5,341,124 | 8/1994 | Leyden et al. | 340/568 |
| 5,345,219 | 9/1994 | Rogers | 340/568 |
| 5,345,220 | 9/1994 | Wachsman | 340/568 |
| 5,379,023 | 1/1995 | Dalton | 340/568 |

*Primary Examiner*—Glen Swann
*Attorney, Agent, or Firm*—Collard & Roe

[57] ABSTRACT

An alarm system for securing an air powered hand tool having a threaded female air intake coupling. The alarm sensor has a secured and an unsecured state which is detectable by an alarm system. The alarm sensor includes an sensor housing and an elongate cord containing a first and second conductor extending from the sensor housing for electrical communication with the alarm system. A male coupling is rotatably mounted to the sensor housing and cooperatively threaded to engage the threaded female coupling. A switch is carried by the male coupling and connected between the first and second conductors. The switch is responsive to the relative position of the male coupling with respect to the threaded female coupling. By unscrewing the male coupling from the threaded female coupling, the alarm sensor is placed in the unsecured state.

13 Claims, 3 Drawing Sheets

ANTI-THEFT ALARM FOR AIR POWERED HAND TOOLS

BACKGROUND OF THE INVENTION

1. Field of the Invention

The invention relates to an anti-theft alarm for air powered hand tools. More particularly, it relates to an alarm sensor which is screwed into the threaded female air-intake coupling of each tool.

2. The Prior Art

The prior art discloses various alarm systems for protecting clothing or other merchandise which is on display. An example of the prior art patents is as follows: U.S. Pat. Nos. 4,837,555 to Millar; 5,241,297 to Goodman; 5,258,744 to Zeder; 5,341,124 to Leyden; 5,345,219 to Rogers; 5,345,220 to Wachsman; 5,347,262 to Thurmond; and 5,379,023 to Dalton. These patents generally include alarm sensors which are attached to the product being displayed. However, the prior art does not disclose an alarm for securing an air powered hand tool by the tool's threaded female air intake coupling. Such a device would be desirable since it would not interfere with the display of the air powered hand tool.

SUMMARY OF THE INVENTION

It is, therefore, an object of the present invention to overcome the drawbacks of the prior art and to provide an alarm sensor for securing an air powered hand tool on display.

It is a further object of the present invention to provide an alarm which attaches to the threaded female air intake coupling of the air powered hand tool.

It is yet another object of the present invention to provide an alarm in which the alarm sensor and the alarm system provide visual means for readily indicating the state of any one of the sensors.

These and other related objects are achieved according to the invention by an alarm sensor for securing an object with a threaded female coupling. The alarm sensor has a secured state and an unsecured state detectable by an alarm system. The alarm sensor includes a sensor housing and an elongated cord containing a first and second conductor extending from the sensor housing for electrical communication with the alarm system. A male coupling is rotatably mounted to the sensor housing and cooperatively threaded to engage the threaded female coupling. Switch means, carried by the male coupling, is connected between the first and second conductors. The switch is responsive to the relative position of the male coupling with respect to the threaded female coupling so that unscrewing the male coupling from the threaded female coupling places the alarm sensor in the unsecured state. An illumination device, such as a two color LED lamp may be positioned on the sensor housing for selectively emitting light in two different colors to indicate the state of the alarm sensor. The sensor housing includes a fixed post extending outwardly therefrom with the male coupling rotatably mounted thereon.

The switching device includes a limit switch that is connected between the first and second conductors and securely attached to the fixed post. A switch actuator is disposed exteriorly on the male coupling for contacting the threaded female coupling and activating the limit switch. Screwing the male coupling into the threaded female coupling depresses the switch actuator and closes the limit switch to place the alarm sensor in the secured state. The switching device is biased to open the limit switch and place the alarm sensor in the unsecured state as the male coupling is unscrewed from the threaded female coupling.

The switch actuator is formed as a cross-shaped resilient disc having substantially the same diameter as the male coupling threads. The resilient disc extends on a shaft outwardly from the free end of the male coupling and the shaft becomes depressed in the axial direction toward the limit switch as soon as the male coupling is secured into the threaded female coupling. Alternatively, the switch actuator extends outwardly in the radial direction at least partially beyond the thread of the male coupling. The radially disposed switch actuator may consist of a ball bearing which is forced radially inwardly upon contact with the threaded female coupling to mechanically close a micro switch. Alternatively, the switch actuator consists of two radially extending contacts which are electrically coupled together by common contact with an electrically conductive female coupling. When a two color LED lamp is positioned on the alarm sensor, it includes a common cathode connected to the first conductor. The switch is connected between the second hot conductor and a contact of the first LED. A resistor is connected between the second hot conductor and the anode of the second LED. Current is directed to one of the two anodes based on the position of the switch. When the switch is closed, a lower resistance is provided than the resistor, and the first LED is lit. When the switch is open, a higher resistance than the resistor is provided and the second LED becomes illuminated.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
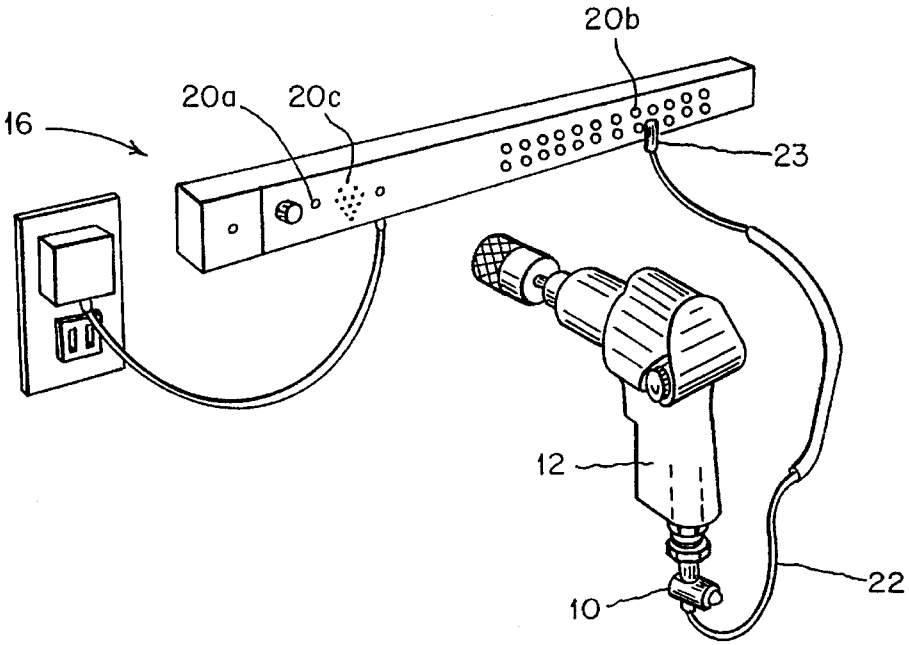
FIG. 1 is a perspective view of the alarm system according to the invention with the alarm sensor attached to the threaded female air intake coupling of the tool to be secured.
Figure 2:
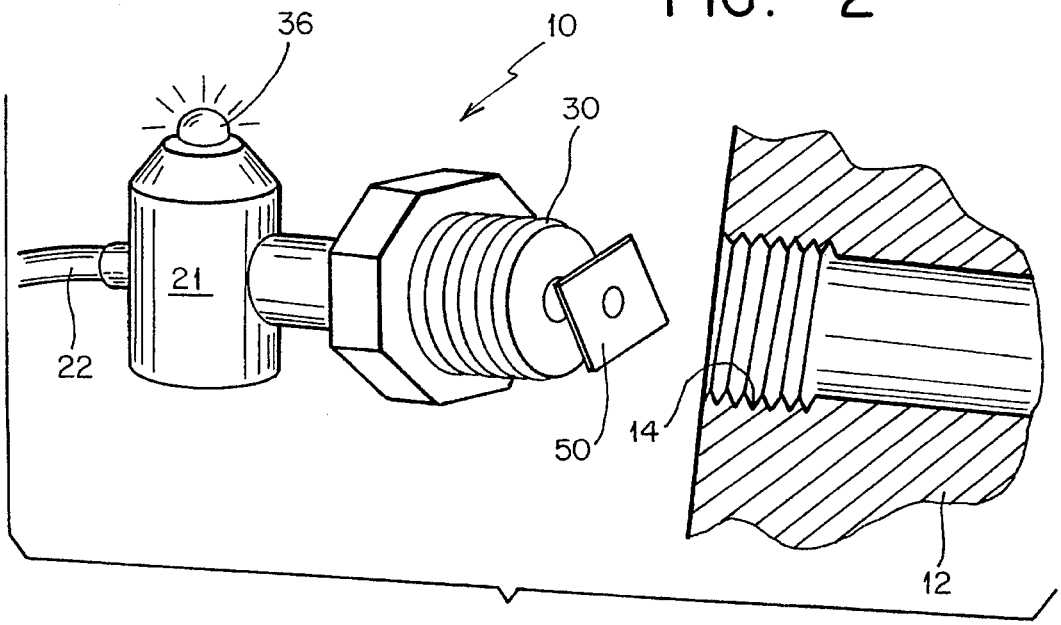
FIG. 2 is an enlarged perspective view of the alarm sensor and air intake coupling of the tool.
Figure 3:
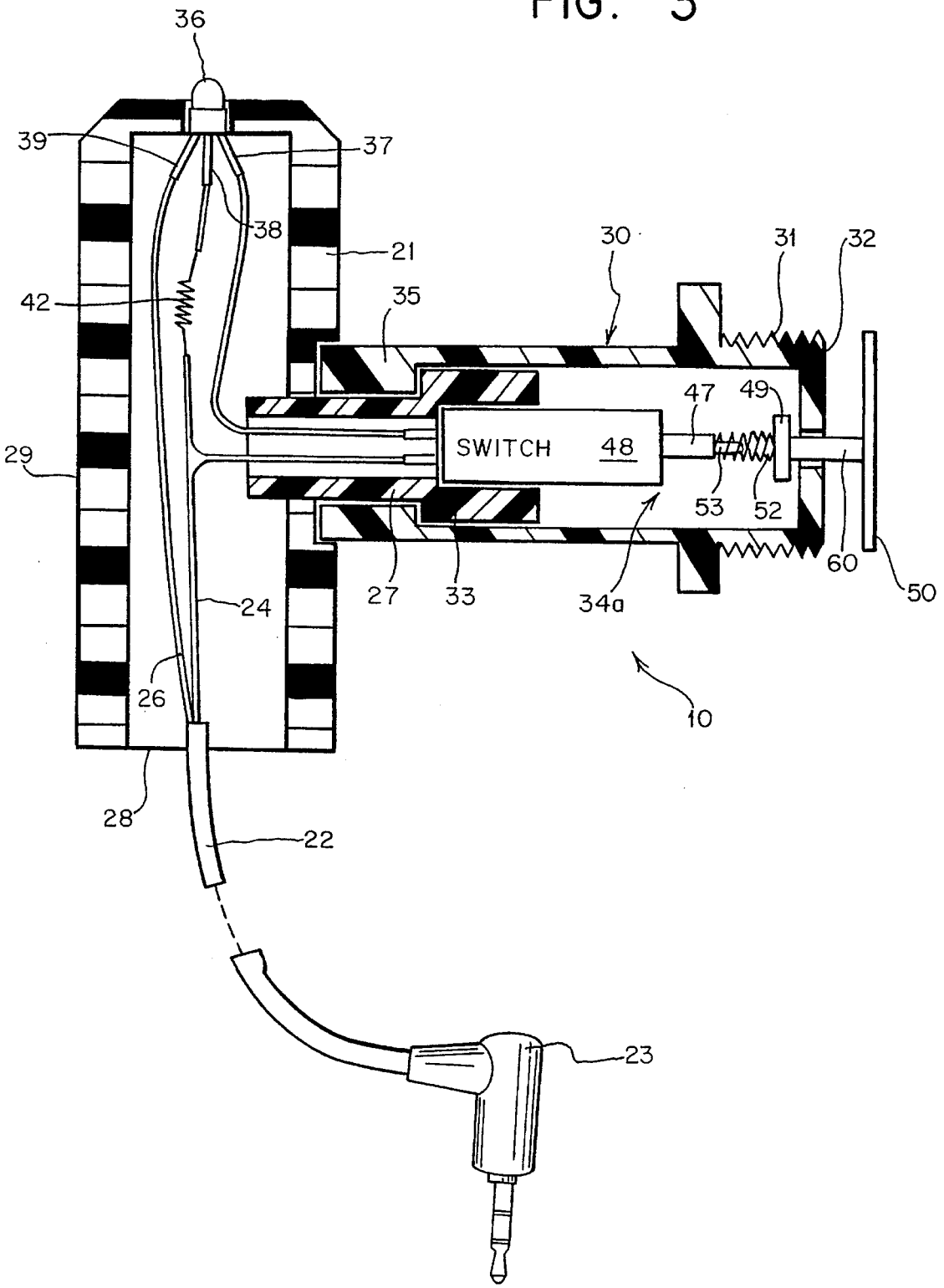
FIG. 3 is a cross-sectional view of the alarm sensor.

Referring now in detail to the drawings, and in particular FIGS. 1–3, there is shown an alarm sensor 10 with a male coupling 30 for connection to a displayed object or air powered hand tool 12. Alarm sensor 10 includes a sensor housing 21 and a fixed post 27 which is securely attached to sensor housing 21, for example, by gluing or other suitable means. Male coupling 30 has a radially inwardly extending collar 35 which is axially retained between sensor housing 21 and a radially outwardly extending collar 33 of post 27. While a switch 48, post 27 and housing 21 are securely connected together, male coupling 30 is free to rotate. Hand tool 12 is provided with a threaded female air-intake coupling 14. As male coupling 30 is screwed into the threads of female coupling 14, resilient disc 50, connected to one end of switch actuator 60 will contact and engage threads 14. Disc 50 will engage the first thread 14 so that continued rotation of male coupling 30 will axially displace switch actuator 60 toward housing 21 to close switch 48 and place the alarm in a secured state.

As can be seen in FIG. 3, a spring 52 normally biases switch actuator 60 outwardly of male coupling 30 until a collar 49 contacts the inner surface of male coupling 30. In this position, spring 52 is in a substantially relaxed state. Plunger 47 of switch 48 is biased outwardly toward free end 32 wherein switch 48 is open. The outwardly biasing force of plunger 47 exceeds the tensile force of spring 52 when it is in the substantially relaxed state. Thus, when switch actuator 60 is free, the biasing force of plunger 47 and spring 52 maintains switch 48 in an open state. A ferrule or bushing 53 is mounted on the end of plunger 47 to keep spring 52 centered on plunger 47.

Disc 50 is preferably constructed of a thin wafer-like flexible material and may be circular, star shaped or rectangular as shown. Upon engaging the first female thread 14, disc 50 releasably locks into the thread so that its edges can snap from thread to thread as coupling 30 is screwed in and seated. Coupling 30 rotates relative to actuator 60 as disc 50 locks against threads 14. Thus, after coupling 30 has been rotated only a few turns into female coupling 14, actuator 60 will be compressed to activate switch 48.

Since coupling 30 is freely rotatable with respect to housing 21, the secured tool can be handled without twisting cord 22. If a person attempts to remove coupling 30 from threads 14, disc 50 initially does not move with respect to threads 14. Actuator 60 is withdrawn axially out of coupling 30 and thus activates alarm switch 48, well before coupling 30 becomes disengaged from the object. Thus, the alarm will sound after just a few counter-clockwise turns, well before the air tool or other object becomes disengaged from the cord.

Alarm sensor 10 is connected to an alarm system 16 by a plug 23 of a flexible cord 22 containing a first conductor 24 and a second conductor 26. A bi-color LED 36 is located on sensor housing 21. LED 36 includes a first anode 37, a second anode 38, and a common cathode 39. Applying current across contacts 37 and 39 illuminates a green LED, for example, signalling the secured state. Applying current across contacts 38 and 39 illuminates a red LED, for example, signalling the unsecured state. Power is applied to conductors 24 and 26 via plug 23. Second conductor 26, designated as the cathode conductor, is coupled to common cathode 39 of LED 36. First conductor 24, designated as the hot lead, is connected to a resistor 42 and switch 48. The other contact of switch 48 is coupled to the first green anode 37. The second end of resistor 42 is coupled to the second red anode 38. Either the red or green LED will be illuminated based on the position of switch 48. When switch 48 is opened, an open circuit exists to first green anode 37. Current passes from first conductor 24, through resistor 42 and second red anode 38. When switch 48 is closed, the path to first green anode 37 is at a lower resistance than the path through resistor 42 to second red anode 38. Accordingly, when switch 48 is closed, current passes through first green anode 37.

Depending on the position of switch 48, current will pass either through switch 48 or through resistor 42. Since resistor 42 provides an overall higher resistance, the current will be lower when switch 48 is open. Alarm system 16 monitors the current passing through alarm sensor 10. In the secured state, when the current is above a threshold level, LEDs **20*a* and 20*b* are lit green, for example. In the unsecured state, when the current drops below the threshold value, LED 20*b* is switched to red, for example, indicative of the unsecured state. An audible alarm 20*c*** may also be activated.

If cord 22 is removed from alarm system 16, or if cord 22 is cut, the current will drop to zero which is below the threshold value. Accordingly, if alarm sensor 10 is removed from threaded female coupling 14, or cut or disconnected from alarm system 16, alarm signal 16 will signal a breach of security. A large number of sensors 10 may be connected to a single alarm system 16, by connecting their respective cords 22 in parallel. The system is designed to accept one or more cords 22 with plugs without adding shunt plugs to unused jacks. When multiple tools are secured with alarm sensors 10 and alarm system 16, each LED 36 and LEDs **20*a* and 20*b* would indicate a secure condition. The various tools on display could be readily viewed by customers. In the event that one of the alarm sensors 10 or cords 22 is tampered with, alarm 20*c* of alarm system 16 would be activated to notify security personnel as to the general location of the security breach. LED 20*b* and LED 36 corresponding to the tampered alarm sensor would switch to red while all of the remaining LEDs would remain green. In this way, the tampered alarm sensor could be easily identified, which is a distinct advantage where a large number of items are displayed. In the absence of the tamper evident signal, every alarm sensor would need to be checked in order to restore the system to a secured state. The alarm sensor 10** which was tampered with, could easily be identified at a glance, even where a large number of tools and corresponding sensors are displayed.

Figure 4:
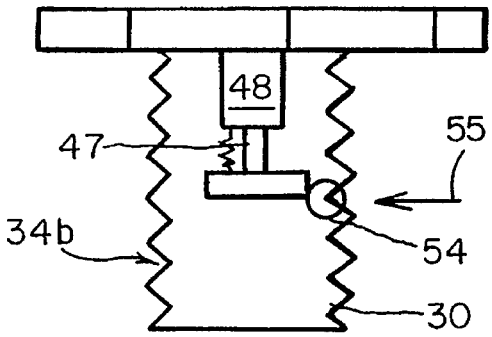
FIG. 4 is an alternate embodiment of the alarm sensor.

As can be seen in FIG. 4, plunger 37 may also be activated by a ball bearing 54 which is positioned for radial movement within male coupling 30. Ball bearing 54 extends radially beyond the threads of male coupling 30. When male coupling 30 is screwed into female coupling 14, ball bearing 54 is radially displaced in direction 55. This depresses plunger 47 to close switch 48.

Figure 5:
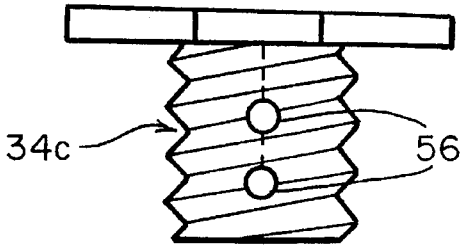
FIG. 5 is a further embodiment of the alarm sensor.
Figure 6:
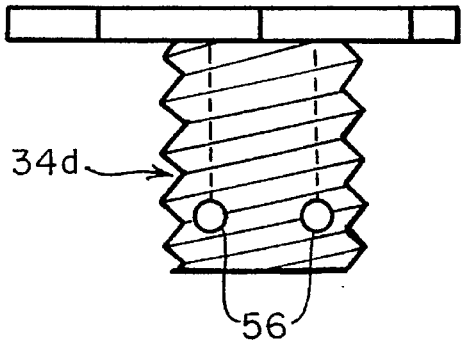
FIG. 6 is yet another embodiment of the alarm sensor.

Alternatively, electrical spaced-apart contacts 56 may be used, as shown in FIGS. 5 and 6. Contacts 56 would thus act as an open circuit which is closed by joint contact with the metal threads of female coupling 14. The embodiments of FIGS. 4, 5 and 6 are only exemplary of many other mechanical and electrical switches which may be employed within the scope of the invention. The key factor is that the switch is electrically or mechanically closed when male coupling 30 is engaged within threaded female coupling 14. Upon partially unscrewing male coupling 30, the switch is opened, signalling an unsecured state both at alarm sensor 10 and at alarm system 16. Thus, an alarm is sounded before male coupling 30 is removed from the tool. Cord 22 is shown in FIG. 3 as exiting sensor housing 21 at bottom 28, opposite LED 36. Cord 22 is also shown in FIG. 1 and 2 as exiting sensor housing 21 at a side 29, opposite male coupling 30.

While several embodiments of the present invention have been shown and described, it is to be understood that many changes and modifications may be made thereunto without departing from the spirit and scope of the invention as defined in the appended claims.

What is claimed is:

1. An alarm sensor for securing an object with a threaded female coupling, the alarm sensor having a secured and an unsecured state detectable by an alarm system, the alarm sensor comprising:

a sensor housing and an elongated cord containing a first and second conductor extending from said sensor housing for electrical communication with the alarm system;

a male coupling rotatably mounted to said sensor housing and cooperatively threaded to engage the threaded female coupling of the object; and switch means carried by said male coupling and connected between said first and second conductors, said switch means being responsive to the relative position of said male coupling with respect to the threaded female coupling so that unscrewing said male coupling from the threaded female coupling activates said switch means to place the alarm sensor in the unsecured state.

2. The alarm sensor according to claim 1, comprising illumination means positioned on said sensor housing for visually indicating the state of the alarm sensor.

3. The alarm sensor according to claim 2, said illumination means comprising a light emitting device for selectively emitting light in two different colors corresponding to the two states of the alarm sensor.

4. The alarm sensor according to claim 3, comprising a resistor;

wherein said light emitting device includes (i) a common cathode connected to said first conductor;

(ii) a first anode and a first LED of a first color between said common cathode and said first anode, said switch means is connected between said second conductor and said first anode;

(iii) a second anode and a second LED of a second color between said common cathode and said second anode, said resistor is connected between said second conductor and said second anode;

wherein said closed switch means provides a lower resistance than said resistor to illuminate said first LED, said open switch means provides a higher resistance than said resistor to illuminate said LED.

5. The alarm sensor according to claim 1, wherein said sensor housing includes a fixed post extending outwardly therefrom with said male coupling rotatably mounted thereon.

6. The alarm sensor according to claim 5, wherein said switch means comprises:

a limit switch connected between said first and second conductors and securely attached to said fixed post;

a switch actuator disposed exteriorly on said male coupling for contacting the threaded female coupling and activating said limit switch;

wherein screwing said male coupling into the threaded female coupling depresses said switch actuator to place the alarm sensor in the secured state.

7. The alarm sensor according to claim 6, wherein said switch means is biased to open said limit switch and place the alarm sensor in the unsecured state as said male coupling is unscrewed from the threaded female coupling.

8. The alarm sensor according to claim 7, wherein said male coupling includes a free end which faces the threaded female coupling and moves along an axial direction during engagement and disengagement of the couplings, said switch actuator extends outwardly from said free end and is depressed in the axial direction toward said limit switch as said male coupling is screwed into the threaded female coupling.

9. The alarm sensor according to claim 8, wherein said switch actuator includes a resilient disc having substantially the same diameter as said male coupling threads.

10. The alarm sensor according to claim 9, wherein said disc is shaped with outwardly extending portions for engaging the threaded female coupling.

11. The alarm sensor according to claim 7, wherein said male coupling includes threads which extend outwardly in a radial direction, said switch actuator extends outwardly in the radial direction at least partially beyond the threads and is depressed radially inwardly as the threads engage the threaded female coupling.

12. The alarm sensor according to claim 5, wherein said male coupling is made from a non-conductive material, and the threaded female coupling is made from a conductive material;

wherein said switch means comprises a pair of spaced contacts disposed on said male coupling, wherein the alarm sensor is placed in the secured state when said pair of contacts both touch the threaded female coupling.

13. The alarm sensor according to claim 12, wherein the alarm sensor is placed in the unsecured state when said male coupling is unscrewed sufficiently to move one of said pair of contacts out of touch with the threaded female coupling.

* * * * *